US005934192A

United States Patent [19]

Ogita et al.

[11] Patent Number: 5,934,192

[45] Date of Patent: Aug. 10, 1999

[54] PRINTING BLANKET

[75] Inventors: Toshikazu Ogita, Miki; Seiji Tomono; Hiromasa Okubo, both of Kobe; Takamichi Sagawa, Akashi, all of Japan

[73] Assignee: Sumitomo Rubber Industries, Ltd., Hyogo, Japan

[21] Appl. No.: 09/015,763

[22] Filed: Jan. 29, 1998

[30] Foreign Application Priority Data

Jan. 29, 1997 [JP] Japan ..... 9-015675

[51] Int. Cl.[6] ..... B41F 7/02

[52] U.S. Cl. ..... 101/217; 101/376; 428/909

[58] Field of Search ..... 101/217, 376, 101/375; 428/909

[56] References Cited

U.S. PATENT DOCUMENTS

| | | | |
|---|---|---|---|
| 4,042,743 | 8/1977 | Larson et al. | 428/306 |
| 4,981,750 | 1/1991 | Murphy et al. | 428/220 |
| 5,066,537 | 11/1991 | O'Rell et al. | 428/246 |
| 5,440,981 | 8/1995 | Vrotacoe et al. | 101/217 |
| 5,478,637 | 12/1995 | Tomono et al. | 428/246 |
| 5,754,931 | 5/1998 | Castelli et al. | 399/297 |

*Primary Examiner*—Edgar Burr
*Assistant Examiner*—Dave A. Ghatt

[57] ABSTRACT

A printing blanket in which an open cell compressible layer and a closed cell compressible layer are provided inside a surface printing layer, which has such superior characteristics that it has the advantages of both the compressible layers and does not cause a variety of problems which are caused by the disadvantages of both the compressible layers.

4 Claims, 1 Drawing Sheet

PRINTING BLANKET

BACKGROUND OF THE INVENTION

1. Field of the Invention

The present invention relates to a printing blanket in a seamless cylindrical shape which is particularly suitable for use in high-speed printing presses such as high-speed web offset printing presses.

2. Description of the Prior Art

Examples of a printing blanket particularly suitable for high-speed printing presses such as high-speed web offset printing presses include a printing blanket in a seamless cylindrical shape in the circumferential direction thereof.

The above-mentioned printing blanket is constructed by suitably laminating inside a seamless surface printing layer composed of an elastomer such as rubber, a porous and seamless compressible layer composed of an elastomer such as rubber, a non-stretchable layer formed by winding a non-stretchable thread in helical fashion in the circumferential direction, and the like.

A so-called air-type printing blanket having a compressible layer as described above is lower in compressive stress in a nip deformed portion produced by being pressed against a plate cylinder or the like, and is superior in impact absorbability because a variation in the compressive stress caused by the change in the amount of distortion is smaller, as compared with a solid-type printing blanket having no compressible layer, so that it is superior in the effect of preventing impact produced at the time of feeding gears of the printing press, for example, from affecting printing precision.

The solid-type printing blanket causes so-called bulge by stress concentrations on the surface printing layer in the above-mentioned nip deformed portion, which might result in inferior printing such as out of register, inferior paper feeding, double, or deformation of a dot pattern (particularly, dot gain) due to expansion in the circumferential direction. On the other hand, the air-type printing blanket also has the effect of preventing the above-mentioned inferior printing because the compressible layer has the function of lowering stress concentrations on the surface printing layer.

Examples of the above-mentioned compressible layer include a compressible layer having a closed cell structure in which cells are independent of each other, which is formed by expanding matrix rubber using an expanding agent which is decomposed by heating to emit a gas, or blending a hollow microsphere with matrix rubber, for example, and a compressible layer having an open cell structure in which cells connect with each other, which is formed by a so-called leaching method for dispersing in matrix rubber particles, such as common salt particles, extractable by a solvent (water in the case of the common salt particles) which does not affect rubber, vulcanizing the matrix rubber, and then extracting the particles.

However, the compressible layers having the above-mentioned structures respectively have both advantages and disadvantages. The printing blanket having the compressible layer whose structure has the advantage particularly required for printing is forced to be employed by closing our eyes to the disadvantage of the compressible layer.

Specifically, the compressible layer having a closed cell structure (hereinafter referred to as "closed cell compressible layer") is high in tensile strength corresponding to a shear force produced by being pressed against a plate cylinder or the like and therefore, is superior in the property of quickly returning to the original shape after deformation due to compression, that is, stability, as compared with the compressible layer having an open cell structure (hereinafter refereed to as "open cell compressible layer").

Therefore, the printing blanket having the open cell compressible layer exhibits the tendency of the printing pressure to fall below a predetermined value because once the open cell compressible layer has a nip deformed portion produced by being pressed against a plate cylinder, it is not quickly restored by the time the printing blanket makes one revolution to reach the nip deformed portion, thereby causing a so-called permanent set in fatigue; while the printing blanket having the closed cell compressible layer can maintain predetermined printing pressure particularly in high-speed printing because it does not cause the above-mentioned permanent set in fatigue.

The above-mentioned printing blanket having the closed cell compressible layer is quickly restored after being partially, greatly deformed because foreign matter is interposed between the printing blanket and the plate cylinder, thereby making it possible to keep such inferior printing that there are traces of the deformation of the printing blanket due to the foreign matter on prints to a minimum.

However, the closed cell compressible layer is higher in compressive stress in the nip deformed portion and is subjected to a larger variation in the compressive stress caused by the change in the amount of distortion, as compared with the open cell compressible layer, so that it is low in the above-mentioned impact absorbability. The printing blanket having the closed cell compressible layer easily exerts a bad influence on printing precision, for example, by impact produced at the time of feeding gears of the printing press, though the influence is not so large as that in the printing blanket of a solid type.

On the other hand, the open cell compressible layer is low in compressive stress in the nip deformed portion and is superior in impact absorbability because a smaller variation in the compressive stress caused by the change in the amount of distortion is smaller, as compared with the closed cell compressible layer as described above. Accordingly, the printing blanket having the open cell compressible layer is superior in the effect of preventing impact from affecting printing precision.

However, the open cell compressible layer is low in stability as described above. Therefore, the printing blanket having the open cell compressible layer easily causes the above-mentioned permanent set in fatigue and easily causes a large amount of such inferior printing that there are traces of the deformation of the printing blanket by foreign matter on prints.

Furthermore, the open cell compressible layer is low in tensile strength corresponding to a shear force produced by being pressed against a plate cylinder or the like and therefore, easily expands in the circumferential direction. Accordingly, the printing blanket having the open cell compressible layer causes bulge, which might also result in inferior printing such as dot gain due to the expansion in the circumferential direction, though the degree is not so high as that in the printing blanket of a solid type.

SUMMARY OF THE INVENTION

An object of the present invention is to provide a printing blanket having such superior characteristics that the above-mentioned various problems do not occur because it has the advantages of both a closed cell compressible layer and an open cell compressible layer.

The printing blanket according to the present invention is in a seamless cylindrical shape, which is characterized in that an open cell compressible layer and a closed cell compressible layer are provided inside a surface printing layer.

The printing blanket according to the present invention has both the open cell compressible layer and the closed cell compressible layer as described above and therefore, has the advantages of both of the compressible layers.

In the printing blanket according to the present invention, it is preferable that the open cell compressible layer is arranged inside the closed cell compressible layer.

When both the layers are arranged in such an order, it is possible to more reliably prevent the above-mentioned inferior printing such as dot gain due to the occurrence of bulge.

It is preferable that both the open cell compressible layer and the closed cell compressible layer are formed of matrix rubber 40 to 80° in JIS A hardness which is defined in K6301 in Japanese Industrial Standard (JIS).

It is preferable that the porosity of each of the compressible layers is 30 to 70%.

Furthermore, it is preferable that the proportion of the thickness of the closed cell compressible layer to the total of the thicknesses of both the compressible layers is 30 to 80%.

The printing blanket whose parameters are within the above-mentioned numerical ranges is superior in balance between the characteristics of both the compressible layers and is further superior in each of the above-mentioned characteristics.

The foregoing and other objects, features, aspects and advantages of the present invention will become more apparent from the following detailed description of the present invention when taken in conjunction with the accompanying drawings.

DETAILED DESCRIPTION OF THE INVENTION

Figure 1:
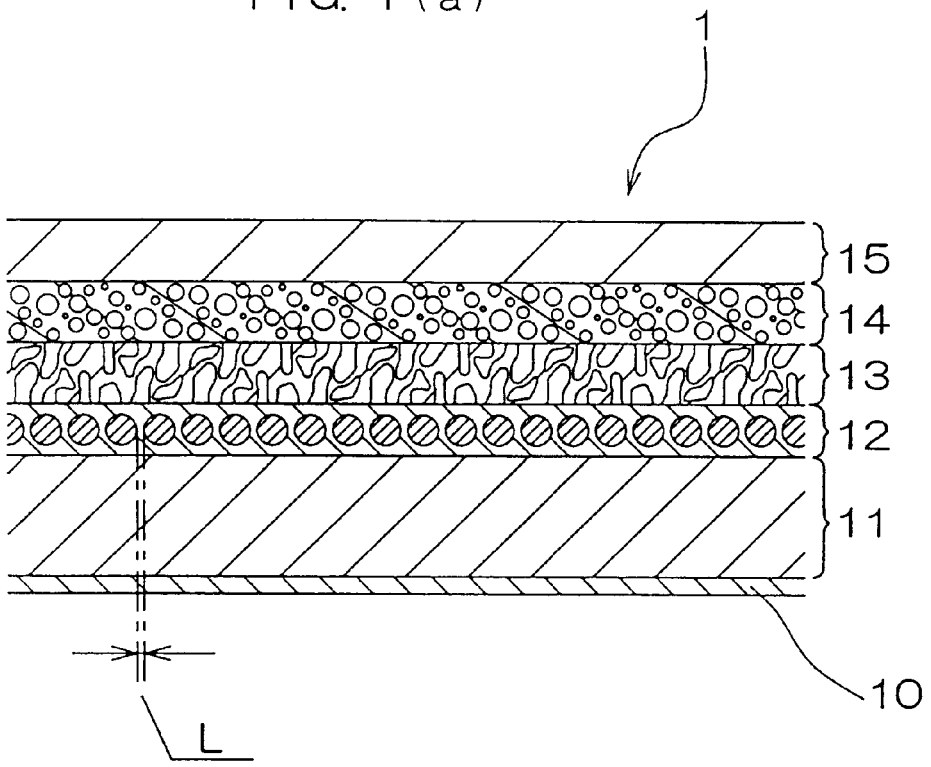
FIG. 1 (*a*) is a partially enlarged sectional view showing one example of a printing blanket according to the present invention, and FIG. 1 (*b*) is a perspective view showing the entire printing blanket.
Figure 1:
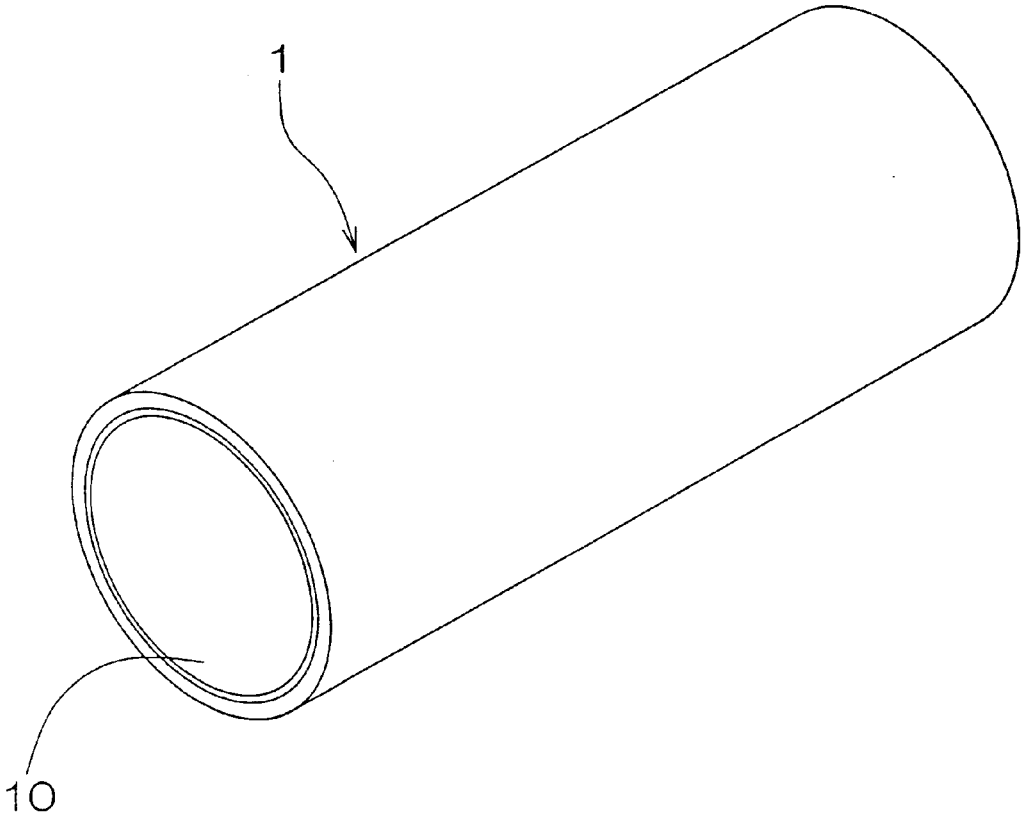

Referring now to the drawings, the present invention will be described.

The printing blanket 1 in the example as shown is formed on the outer peripheral surface of a cylindrical sleeve 10, as shown in FIG. 1 (*b*), and has a base layer 11, a non-stretchable layer 12, an open cell compressible layer 13, a closed cell compressible layer 14, and a surface printing layer 15 laminated in this order on the sleeve 10, as shown in FIG. 1 (*a*). The base layer 11, both the compressible layers 13 and 14, and the surface printing layer 15 are respectively formed in a seamless cylindrical shape.

The order in which the open cell compressible layer 13 and the closed cell compressible layer 14 are laminated may be reversed. However, in order to prevent the above-mentioned inferior printing such as dot gain due to the occurrence of bulge, more reliably, it is preferable that the open cell compressible layer 13 is arranged inside the closed cell compressible layer 14 as shown in FIG. 1 (*a*).

The hardness of the rubber matrix of each of the compressible layers 13 and 14 is preferably in the range of 40 to 80° in terms of JIS A hardness, which is not a limitation.

When the hardness of the rubber matrix composing either one of the compressible layers 13 and 14 is less than the above-mentioned range, the strength of the entire printing blanket 1 is decreased, so that the effects of maintaining stability and preventing bulge may be insufficient. On the contrary, when the hardness of the matrix rubber composing either one of the compressible layers 13 and 14 exceeds the above-mentioned range, the impact absorbability of the printing blanket may be insufficient.

The hardness of the rubber matrix composing each of the compressible layers 13 and 14 is preferably 50 to 70° and more preferably 55 to 65°, particularly in the above-mentioned range.

It is preferable that the porosity of each of the compressible layers 13 and 14 is 30 to 70%.

When the porosity of the open cell compressible layer 13 is less than the above-mentioned range, the volume of open cells in the layer is insufficient, so that the impact absorbability due to the open cells may be insufficient. On the other hand, when the porosity of the closed cell compressible layer 14 is less than the above-mentioned range, the volume of closed cells in the layer is insufficient, so that the effects of maintaining stability and preventing bulge due to the closed cells may be insufficient. On the contrary, when the porosity of either one of the compressible layers 13 and 14 exceeds the above-mentioned range, the strength of the entire printing blanket 1 is decreased, so that the effects of maintaining stability and preventing bulge may be insufficient.

The porosity of each of the compressible layers 13 and 14 is preferably 40 to 60% and more preferably 45 to 55% particularly in the above-mentioned range.

Furthermore, in the present invention, the proportion of the thickness of the closed cell compressible layer 14 to the total of the thicknesses of both the compressible layers 13 and 14 is preferably 30 to 80%.

When the proportion of the thickness of the closed cell compressible layer 14 is less than the above-mentioned range, the effects of maintaining stability and preventing bulge due to the compressible layer 14 may be insufficient. On the contrary, when the proportion of the thickness of the closed cell compressible layer 14 exceeds the above-mentioned range, the proportion of the thickness of the open cell compressible layer 13 is relatively decreased, so that the impact absorbability due to the compressible layer 13 may be insufficient.

The proportion of the closed cell compressible layer 14 is preferably 40 to 70% and more preferably 50 to 60% particularly in the above-mentioned range.

It is preferable that the total thicknesses of both the compressible layers 13 and 14 is approximately 10 to 50% of the total thicknesses of all portions of the blanket, excluding the sleeve 10 and the base layer 11, that is, the non-stretchable layer 12, both the compressible layers 13 and 14 and the surface printing layer 15 in the example as shown and adhesive layers which may be provided among the layers.

When the proportion of the total of the thicknesses of both the compressible layers 13 and 14 is less than the above-mentioned range, the functions of both the compressible layers 13 and 14, that is, the above-mentioned impact absorbability due to the open cell compressible layer 13 may be insufficient, and the effects of maintaining stability and preventing bulge due to the closed cell compressible layer 14 may be insufficient. On the contrary, when the proportion of the total of the thicknesses of both the compressible layers 13 and 14 exceeds the above-mentioned range, the other layers such as the surface printing layer 15 and the non-stretchable layer 12 are too; thin. When the surface printing layer 15 is too thin, the solid applicability of ink is decreased. On the other hand, when the non-stretchable layer 12 is too thin, the effect of regulating the movement of the entire printing blanket in the direction of shearing by the non-stretchable layer 12 is decreased, which might result in an increased slur and bulge.

The proportion of the total of the thicknesses of both the compressible layers 13 and 14 is preferably 20 to 40% and more preferably 25 to 35% particularly in the above-mentioned range.

Both the compressible layers 13 and 14 can be formed by the same method as that in the conventional example.

For example, the open cell compressible layer 13 is obtained by dissolving an unvulcanized rubber matrix in a suitable solvent to from a solution and then further blending particles which are used as the basis for forming the open structure with the solution to produce a rubber cement, applying the rubber cement over an underlay (the non-stretchable layer 12 in the example as shown) and drying the rubber cement, and then heating and vulcanizing the rubber cement.

When the particles which are dispersed in a formed layer are leached out on extracted with a suitable solvent, traces of the particles form open cells, so that the open cell compressible layer 13 is formed in a seamless cylindrical shape.

On the other hand, the closed cell compressible layer 14 is obtained by dissolving unvulcanized rubber matrix in a suitable solvent to form a solution and then further blending with the matrix an expanding agent or hollow microspheres which form the basis for the closed cell structure to produce a rubber cement, applying the rubber cement over an underlay (the open cell compressible layer 13 in the example as shown) and drying the rubber cement, and then heating and vulcanizing the rubber cement.

When the expanding agent is used, the expanding agent is decomposed by heat at the time of vulcanization to form a gas. Consequently, closed cells are formed in the rubber matrix, whereby the closed cell compressible layer 14 is formed in a seamless cylindrical shape. On the other hand, when the hollow microspheres are used, it goes without saying that the closed cells are formed simultaneously with the blending.

The open cell compressible layer 13 can be formed in a seamless cylindrical shape even by the vulcanization method wherein an unvulcanized rubber sheet is molded from a rubber compound obtained by adding particles to be latter leached out unvulcanized rubber in the form of a rubber sheet which is wound on the non-stretchable layer 12 using a rubber cement for adhesion, and melting and integrating its seams in the circumferential direction simultaneously with the vulcanization, and then extracting the particles in the same manner as described above.

Similarly, the closed cell compressible layer 14 can be also formed in a seamless cylindrical shape by a method the vulcanization wherein an unvulcanized rubber sheet is molded from a rubber compound obtained by adding an expanding agent or hollow microsphere to unvulcanized rubber in the form of a rubber sheet which is wound on the previous compressible layer 13 using a rubber cement for adhesion, and melting and integrating its seams in the circumferential direction simultaneously with the vulcanization.

Examples of the rubber matrix used in the compressible layers 13 and 14 can includes various types of rubber. Particularly in consideration of resistance to ink, cleaning solutions and the like, rubbers having excellent oil resistance is preferable. Examples of such oil-resistant rubbers include acrylonitrile-butadiene copolymer rubbers (NBR), chloroprene rubbers (CR), and urethane rubbers (U). However, the use of these rubbers should not be consider as limiting the types of rubbers which can be used.

In order to set the hardness of the matrix rubber in the above-mentioned range, the degree of vulcanization may be adjusted, or the amount of a reinforcing agent, filler, plasticizer or the like to be blended with the rubber may be adjusted.

As particles for forming open cells by the above-mentioned leaching method in the open cell compressible layer 13, those which are extractable by water are suitably used because the use of water as a solvent for extraction is advantageous in terms of safety and cost.

Examples of such particles which are extractable by water include particles of various water-soluble organic and inorganic matter such as common salt (sodium chloride), starch, sugar, polyvinyl alcohol, gelatin, urea, cellulose, sodium sulfate, and potassium chloride.

The particle diameter and the amount of the above-mentioned particles are suitably set in conformity with the above-mentioned porosity of the compressible layer 13.

As the expanding agent for forming closed cells in the closed cell compressible layer 14, a variety of conventionally known expanding agents can be used for the rubber.

Specific examples of expanding agents, which should not be considered limiting include azodicarbonamide, N,N'-dinitrosopentamethylenetetramine, and p,p'-oxybis (benzenesulfonylhydrazide).

On the other hand, examples of the hollow microspheres include those obtained by sealing a gas such as air into a closed shell formed of a thermoplastic resin, a thermosetting resin such as a phenol resin, or an inorganic matter such as glass. A shell formed of a flexible thermoplastic resin is particularly preferable in maintaining the flexibility of the compressible layer 14.

Examples of the hollow microspheres having such a shell made of a thermoplastic resin include the EXPANCEL SERIES available from EXPANCEL Corporation in which a shell is formed of a copolymer of vinylidene chloride and acrylonitrile, which is only exemplary and therefor is not a limitation as utilized in the present invention.

The amount of addition of the expanding agent, or the particle diameter, or the amount of addition of the hollow microsphere may be suitably set in conformity to the above-mentioned porosity of the compressible layer 14.

The sleeve 10, the base layer 11, the non-stretchable layer 12 and the surface printing layer 15, which together with both the compressible layers 13 and 14, constitute the printing blanket 1 may have the same structures as those in conventional examples.

Examples of the sleeve 10 include one formed of a very thin metallic material such as a nickel thin plate, or one formed of glass fiber reinforced plastic.

Each of the base layer 11 and the surface printing layer 15 is formed by vulcanizing an unvulcanized rubber layer formed by applying and drying a rubber cement or an unvulcanized rubber sheet composed of a rubber compound. Both layers are formed in a seamless, cylindrical shape. Also, both layers are substantially non-porous.

As the rubber used as the base layer 11 out of the above-mentioned layers, the above-mentioned oil-resistant rubber such as NBR, CR, or U is suitably used. As the rubber for the surface printing layer 15, the above-mentioned oil-resistant rubbers such as NBR, CR, or U is suitably used. In addition thereto, polysulfide rubber (T), hydrogenated NBR, or the like can be also used.

The non-stretchable layer 12 is formed by winding a thread which is non-stretchable such as a cotton string, a polyester string, a rayon string, a nylon string in a helical fashion along its length, and an aromatic polyamide string around the base layer 11 coated with a rubber cement while applying a tensile force thereto, and then vulcanizing and fixing the rubber cement.

The thickness of each of the layers may be the same as that in the conventional example. Further, the diameter of the thread constituting the non-stretchable layer 12 may be approximately the same as that in the conventional example. Specifically, it is preferable that the thickness of the base layer 11 is approximately 0.5 to 2.0 mm, the thickness of the surface printing layer 15 is approximately 0.2 to 0.5 mm, and the diameter of the thread constituting the non-stretchable layer 12 is approximately 0.1 to 0.5 mm.

The above-mentioned layers constituting the printing blanket 1 are successively laminated, the order being first the layer closest to the sleeve 10. Each of the layers may be vulcanized every time it is formed. Alternatively, a plurality of layers may be vulcanized together. It is preferable that the open cell compressible layer 13 is vulcanized before the closed cell compressible layer 14 is laminated in terms of extraction of particles by the leaching method as described above, to extract the particles.

The printing blanket 1 in a cylindrical shape is used with it being mounted on the blanket cylinder of the printing press.

Various types of additives can be blended with the rubber compound or the rubber cement for each of the layers constituting the printing blanket 1 in the above-mentioned example as shown.

Examples of such additives include an antioxidant, a reinforcing material, a filler, a softener, and a plasticizer in addition to compounds for vulcanizing rubber such as a vulcanizing agent, a vulcanization accelerator, an activator, and a retarder. The amount of addition of the additive may be approximately the same as that in the conventional example.

Examples of the vulcanizing agent include sulfur, an organic sulfur compound, and an organic peroxide. Examples of the organic sulfur compound include N,N'-dithiodimorpholine. Examples of the organic peroxide include benzoyl peroxide and dicumyl peroxide.

Examples of the vulcanization accelerator include organic accelerators, as thiuram vulcanization accelerators such for example tetramethylthiuramdisulfide and tetramethylthiurammonosulfide; dithiocarbamic acids such as zinc dibutyldithiocarbamate, zinc diethyldithiocarbamate, sodium dimethyldithiocarbamate, and tellurium diethyldithiocarbamate; thiazoles such as 2-mercaptobenzothiazole and N-cyclohexyl-2-benzothiazolesulfenamide; and thioureas such as trimethylthiourea and N,N'-diethylthiourea, or inorganic accelerators such as slaked lime, magnesium oxide, titanium oxide, and litharge (PbO).

Examples of the activator include metal oxides such as zinc oxide, or fatty acids such as stearic acid, oleic acid, and cottonseed fatty acid.

Examples of the retarder include aromatic organic acids such as salicylic acid, phthalic anhydride, and benzoic acid; and nitroso compounds such as N-nitrosodiphenylamine, N-nitroso-2,2,4-trimethyl-1,2-dihydroquinone, and N-nitorosophenyl-β-naphtylamine.

Examples of the antioxidant include imidazoles such as 2-mercaptobenzimidazole; amines such as phenyl-α-naphthylamine, N,N'-di-β-naphthyl-p-phenylenediamine, and N-phenyl-N'-isopropyl-p-phenylenediamine; and phenols such as di-t-butyl-p-cresol and styrenated phenol.

As the reinforcing agent, carbon black is mainly used. Further examples of the reinforcing agent include inorganic reinforcing materials such as silica or silicate white carbon, zinc oxide, surface treated precipitated calcium carbonate, magnesium carbonate, talc, and clay, or organic reinforcing agent such as coumarone-indene resin, phenol resin, and high styrene resin (a styrene-butadiene copolymer having a large styrene content).

Examples of the filler include inorganic fillers such as calcium carbonate, clay, barium sulfate, diatomaceous silica, mica, asbestos, and graphite, or organic fillers such as reclaimed rubber, rubber powder, asphalts, styrene resin, and glue.

Examples of softeners include various softeners of a vegetable oil, a mineral oil and a synthetic oil such as fatty acids (stearic acid, lauric acid, etc.), cottonseed oil, tall oil, asphalts, and paraffin wax.

Examples of the plasticizer include various plasticizers such as dibutyl phthalate, dioctyl phthalate, and tricresyl phosphate.

In addition thereto, a tackifier, a dispersant, a solvent, or the like may be suitably blended with rubber.

The construction of the printing blanket according to the present invention is not limited to that in the example described above. Various design changes can be made in the range in which the gist of the present invention is not changed.

The positions of both the compressible layers 13 and 14 and the upper-and-lower relationship therebetween in the cylindrical printing blanket 1 shown in FIGS. 1 (*a*) and 1 (*b*), for example, can be suitably changed. For example, the order in which the compressible layers 13 and 14 are laminated may be reversed as described above. Although in the example as shown, both the compressible layers 13 and 14 are directly brought into contact with each other, the other layer, for example, the non-stretchable layer may be interposed between both the compressible layers 13 and 14.

In the present invention, the structures of the other layers can be suitably changed.

In short, provided that the open cell compressible layer and the closed cell compressible layer are provided inside the surface printing layer, the other construction is not particularly limited in the present invention.

As described in detail in the foregoing, according to the present invention, there can be provided a printing blanket having superior characteristics, which has both the advantages of the closed cell compressible layer and the open cell compressible layer and may not cause various problems which are caused by the disadvantages of both the compressible layers.

EXAMPLES

The present invention will be described on the basis of examples and comparative examples.

Example 1

An unvulcanized rubber sheet to be a base layer having a thickness of 2.0 mm composed of a rubber compound containing unvulcanized NBR was wound around an outer peripheral surface of a cylindrical sleeve made of nickel having an inside diameter of 169.5 mm, having a length of 910 mm, and having a thickness of 0.125 mm with an adhesive layer having a two-layer structure comprising a layer of Chemlock 205 and a layer of Chemlock 252X which are available from Lord Chemical Corporation (0.05 mm in total thicknesses) interposed therebetween, after which each of the above-mentioned layers was vulcanized in a state where the surface of the rubber sheet was wrapped, and the surface of the rubber sheet after the vulcanization was polished, to form a base layer having a thickness of 1.4 mm.

An adhesive layer (0.05 mm in thickness) was then formed of a rubber cement containing unvulcanized NBR on the above-mentioned base layer, and a cotton string (NE60/8; 0.250 mm in diameter) was wound in helical fashion in such a manner that the spacing L [shown in FIG. 1(*a*)] between its adjacent parts was not more than 0.05 mm while applying a tensile force of 380±10 gf, after which the rubber cement was vulcanized in a state where the surface thereof was wrapped, to form a non-stretchable layer having a thickness of 0.3 mm.

An adhesive layer (0.05 mm in thickness) was then formed of a rubber cement containing unvulcanized NBR on the above-mentioned non-stretchable layer, a rubber cement for an open cell compressible layer containing 100 parts by weight of unvulcanized NBR [DN206 available from Nippon Zeon Co., Ltd.], 50 parts by weight of common salt particles (1 to 100 μm in particle diameter), and the following ingredients was spread thereon and dried, and the adhesive layer and the rubber cement layer for compressible layer were vulcanized in a state where the surface of the rubber cement layer was wrapped. Thereafter, the common salt particles were extracted upon being immersed in warm water having a temperature of 70° for 12 hours by leaching processing, and were dried, to form an open cell compressible layer 0.08 mm in thickness, 60° in JIS A hardness of matrix rubber, and 50% in porosity.

| (ingredients) | (parts by weight) |
|---|---|
| Furnace black | 30 |
| Clay filler | 40 |
| Stearic acid | 1 |
| Phenol antioxidant | 1 |
| Powder sulfur | 2.5 |
| Sulfenic amide accelerator | 1.5 |
| Thiuram accelerator | 1 |
| Zinc oxide | 5 |
| Toluene | 100 |

An adhesive layer (0.05 mm in thickness) was formed of a rubber cement containing unvulcanized NBR on the above-mentioned open cell compressible layer, a rubber cement for a closed cell compressible layer containing 100 parts by weight of unvulcanized NBR [N232S available from JSR (Japan Synthetic Rubber) Co., Ltd.], 10 parts by weight of a hollow microsphere [EXPANCEL 461DE available from the above-mentioned EXPANCEL Corporation; 50 μm in particle diameter], and the following ingredients was spread thereon and dried, and the adhesive layer and the rubber cement layer for compressible layer were vulcanized in a state where the surface of the rubber cement layer was wrapped, to form a closed cell compressible layer 0.08 mm in thickness, 60° in JIS A hardness of matrix rubber, and 50% in porosity.

| (ingredients) | (parts by weight) |
|---|---|
| Furnace black | 30 |
| Clay filler | 40 |
| Stearic acid | 1 |
| Phenol antioxidant | 1 |
| Powder sulfur | 2.5 |
| Sulfenic amide accelerator | 1.5 |
| Thiuram accelerator | 1 |
| Zinc oxide | 5 |
| Toluene | 100 |

An adhesive layer (0.05 mm in thickness) was formed of a rubber cement containing unvulcanized NBR on the above-mentioned closed cell compressible layer, a rubber cement for a surface printing layer containing unvulcanized NBR was spread thereon and dried, and the adhesive layer and the rubber cement layer for surface printing layer were vulcanized in a state where the surface of the rubber cement layer was wrapped, after which the surface of the rubber cement layer was polished, to form a surface printing layer having a thickness of 0.2 mm, thereby fabricating a printing blanket in a seamless cylindrical shape having the layer structure shown in FIG. 1 (*a*).

Comparative Example 1

A printing blanket in a seamless cylindrical shape was fabricated in the same manner as that in the example 1 except that the open cell compressible layer was omitted, and two closed cell compressible layers 0.08 mm in thickness were laminated with an adhesive layer 0.05 mm in thickness interposed therebetween.

Comparative Example 2

A printing blanket in a seamless cylindrical shape was fabricated in the same manner as that in the example 1 except that the closed cell compressible layer was omitted, and two open cell compressible layers 0.08 mm in thickness were laminated with an adhesive layer 0.05 mm in thickness interposed therebetween.

Comparative Example 3

A printing blanket in a seamless cylindrical shape was fabricated in the same manner as that in the example 1 except that the open cell compressible layer and the adhesive layer formed thereunder were omitted, and the thickness of the closed cell compressible layer was set to 0.16 mm.

Comparative Example 4

A printing blanket in a seamless cylindrical shape was fabricated in the same manner as that in the example 1 except that the closed cell compressible layer and the adhesive layer formed thereunder were omitted, and the thickness of the open cell compressible layer was set to 0.16 mm.

The following tests were conducted with respect to each of the printing blankets fabricated in the above-mentioned examples and comparative examples, to evaluate the characteristics thereof.

Bulge resistance test

Each of the printing blankets was mounted on a blanket cylinder of an offset printing press [GCX TYPE available from Mitsubishi Heavy Industries, Ltd.], to print a halftone on the surface of coat paper [YUTORIRO COAT available from DAIOU PAPER INDUSTRIES, Ltd.; having a basis weight of 110 kg] under conditions of a printing pressure of 15/100 mm and a printing speed of 10000 sheets/hour.

The area $S_1$ of a printed dot was measured, to find the rate of increase from the area $S_0$ of the dot in an original plate, that is, the dot gain percentage (%) by the following equation (i), thereby evaluating bulge resistance. The above-mentioned dot gain percentage indicates that the smaller its value is, the more excellent the bulge resistance of the printing blanket is.

$$\text{dot gain percentage } (\%) = \frac{(S_1 - S_0)}{} \times 100 \quad \text{(i)}$$

Stability test

Each of the printing blankets was mounted on a blanket cylinder of the same offset printing press as that in the above-mentioned bulge resistance test, and a plate cylinder was pressed at a printing pressure of 15/100 mm.

Coat paper [YUTORIRO COAT available of DAIOU PAPER INDUSTRIES, Ltd.; having a basis weight of 110 kg] having carton 10 cm square having a thickness of 0.2 mm affixed to its center was interposed between the plate cylinder and the printing blanket with the carton directed toward the printing blanket, to partially deform the surface of the printing blanket.

The surface of the coat paper [YUTORIRO COAT available of DAIOU PAPER INDUSTRIES, Ltd.; having a basis weight of 110 kg] was subjected to continuous solid printing by ink "Hi-plus Magenta" available from Toyo Ink Manufacturing Co., Ltd. under conditions of a printing pressure of 15/100 mm and a printing speed of 10000 sheets/hour using the above-mentioned printing blanket immediately after the deformation.

Prints made until there was no difference in density between a deformed portion and its periphery, that is, partial deformation was restored was counted, to evaluate the stability of the printing blanket by the following criteria.

G: high stability because deformation was restored before the 100th print

M: slightly low stability because deformation was restored from the 101th to 500th prints B: low stability because deformation was restored after the 501th print Impact absorbability test Each of the printing blankets was used for the same offset printing press as that in the above-mentioned bulge resistance test, to print a 70% tint by ink "Hi-plus Magenta" available from Toyo Ink Manufacturing Co., Ltd. on the surface of the same coat paper as the foregoing coat paper under conditions of a printing pressure of 15/100 mm and a printing speed of 10000/hour.

It was visually observed whether or not impact produced at the time of feeding gears of the printing press (distortion of dot shape, so-called gear mark) affected printing, to evaluate the impact absorbability of the printing blanket by the following criteria:

G: high impact absorbability because no gear mark can be confirmed

M: slightly low impact absorbability because gear mark is slightly confirmed

B: low impact absorbability because gear mark can be clearly confirmed

The forgoing results were shown in Table 1:

TABLE 1

| | dot gain percentage (%) | impact absorbability | stability |
|---|---|---|---|
| Ex.1 | 12 | G | G |
| Comp.Ex.1 | 10 | B | M |
| Comp.Ex.2 | 17 | M | B |
| Comp.Ex.3 | 10 | M | G |
| Comp.Ex.4 | 17 | G | M |

From the foregoing Table, it was confirmed that the printing blanket in the example 1 had the advantages of both the closed cell compressible layer and the open cell compressible layer because it had approximately the same bulge resistance as that in each of the printing blankets in comparative examples 1 and 3 having only the closed cell compressible layer as well as the stability which was approximately equal to or more than that in each of the comparative examples, and had the impact absorbability which was approximately equal to or more than that in each of the printing blankets in comparative examples 2 and 4 having only the open cell compressible layer.

Examples 2 to 6

Printing blankets in a seamless cylindrical shape having the layer structure shown in FIG. 1 (*a*) were fabricated in the same manner as that in the example 1 except that the amount of blending of a hollow microsphere with a rubber cement which forms the basis of a closed cell compressible layer was adjusted, to set the porosity of the closed cell compressible layer to values shown in Table 2, and the amount of blending of carbon black with a rubber cement which forms the basis of both the closed cell compressible layer and an open cell compressible layer was adjusted, to set the JIS A hardness of matrix rubber in each of the compressible layers to 50°. The porosity of the open cell compressible layer was 50%, the thicknesses of both the compressible layers were 0.08 mm, and the proportion of the thickness of the closed cell compressible layer to the total of the thicknesses of both the compressible layers was 50%.

The above-mentioned tests were conducted with respect to each of the printing blankets in the examples, to evaluate the characteristics thereof. The results thereof were shown in Table 2.

TABLE 2

| | porosity (%) of closed cell compressible layer | dot gain percentage (%) | impact absorbability | stability |
|---|---|---|---|---|
| Ex.2 | 30 | 13 | G | M |
| Ex.3 | 40 | 11 | G | G |
| Ex.4 | 50 | 10 | G | G |
| Ex.5 | 60 | 11 | G | G |
| Ex.6 | 70 | 13 | G | M |

The foregoing Table showed that it was preferable that the porosity of the closed cell compressible layer was approximately 30 to 70% and particularly approximately 40 to 60%.

Examples 7 to 10

Printing blankets in a seamless cylindrical shape having the layer structure shown in FIG. 1 (*a*) were fabricated in the same manner as that in the example 4 except that the amount of blending of common sale particles with a rubber cement which forms the basis of an open cell compressible layer was adjusted, to set the porosity of the open cell compressible layer to values shown in Table 3. The porosity of a closed cell compressible layer was 50%, the thicknesses of both the compressible layers were 0.08 mm, the proportion of the thickness of the closed cell compressible layer to the total of the thicknesses of both the compressible layers was 50%, and the JIS A hardness of matrix rubber of each of the compressible layers was 50°.

The above-mentioned tests were conducted with respect to each of the printing blankets in the examples, to evaluate the characteristics thereof. The results thereof, together with the results in the example 4 were shown in Table 3.

TABLE 3

| | porosity (%) of open cell compressible layer | dot gain percentage (%) | impact absorbability | stability |
|---|---|---|---|---|
| Ex.7 | 30 | 10 | M | G |
| Ex.8 | 40 | 10 | G | G |
| Ex.4 | 50 | 10 | G | G |
| Ex.9 | 60 | 11 | G | G |
| Ex.10 | 70 | 13 | G | M |

The foregoing Table showed that it was preferable that the porosity of the open cell compressible layer was approximately 30 to 70% and particularly approximately 40 to 60%.

Examples 11 to 15

Printing blankets in a seamless cylindrical shape having the layer structure shown in FIG. 1 (*a*) were fabricated in the same manner as that in the example 4 except that the coating thickness of a rubber cement which forms the basis of both a closed cell compressible layer and an open cell compressible layer was adjusted, to set the proportion of the thickness of the closed cell compressible layer to the total of the thicknesses of both the compressible layers (Pt %) to values shown in Table 4. The porosity of each of the compressible layers was 50%, the total of the thicknesses of both the compressible layers was 0.16 mm, and the JIS A hardness of matrix rubber of each of the compressible layers was 50°.

The above-mentioned tests were conducted with respect to each of the printing blankets in the examples, to evaluate the characteristics thereof. The results thereof, together with the results in the example 4 were shown in Table 4.

TABLE 4

| | Pt (%) | dot gain percentage (%) | impact absorbability | stability |
|---|---|---|---|---|
| Ex.11 | 30 | 13 | G | M |
| Ex.12 | 40 | 11 | G | G |
| Ex.4 | 50 | 10 | G | G |
| Ex.13 | 60 | 9 | G | G |
| Ex.14 | 70 | 8 | G | G |
| Ex.15 | 80 | 8 | M | G |

The foregoing Table showed that it was preferable that the proportion of the thickness of the closed cell compressible layer to the total of the thicknesses of both the compressible layer (Pt %) to the total of the thicknesses of both the compressible layer was approximately 30 to 80% and particularly approximately 40 to 70%.

Example 16

A printing blanket in a seamless cylindrical shape having the layer structure shown in FIG. 1 (*a*) was fabricated in the same manner as that in the example 4 except that the order in which a closed cell compressible layer and an open cell compressible layer were formed was reversed. The porosity of each of the compressible layers was 50%, the thicknesses of both the compressible layers were 0.08 mm, and the proportion of the thickness of the closed cell compressible layer to the total of the thicknesses of both the compressible layers was 50%, and the JIS A hardness of matrix rubber of each of the compressible layers was 50°.

The above-mentioned tests were conducted with respect to each of the printing blankets in the example, to evaluate the characteristics thereof. The results thereof, together with the results in the example 4 were shown in Table 5.

TABLE 5

| | dot gain percentage (%) | impact absorbability | stability |
|---|---|---|---|
| Ex.4 | 10 | G | G |
| Ex.16 | 12 | G | G |

The foregoing Table showed that it was preferable that the open cell compressible layer is arranged inside the closed cell compressible layer.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A printing blanket in a seamless cylindrical shape, wherein a compressible layer having an open cell structure and a compressible layer having a closed cell structure are provided inside a surface printing layer and said compressible layer having an open cell structure being arranged inside the compressible layer having a closed cell structure.

2. The printing blanket according to claim 1, wherein both the compressible layers are formed of matrix rubber having a JIS A hardness of 40 to 80°.

3. The printing blanket according to claim 1, wherein the porosity of each of the compressible layers is 30 to 70%.

4. The printer blanket according to claim 1, wherein the proportion of the thickness of the compressible layer having a closed cell structure to the total of the thicknesses of both of the compressible layers is 30 to 80%.

* * * * *